US007185419B2

(12) United States Patent
Kang et al.

(10) Patent No.: US 7,185,419 B2
(45) Date of Patent: Mar. 6, 2007

(54) METHOD OF MANUFACTURING A MASK FOR EVAPORATION

(75) Inventors: Chang Ho Kang, Yangaan (KR); Tae Seung Kim, Rusan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 133 days.

(21) Appl. No.: 10/448,133

(22) Filed: May 30, 2003

(65) Prior Publication Data

US 2003/0221613 A1 Dec. 4, 2003

(30) Foreign Application Priority Data

May 31, 2002 (KR) ..... 2002-30614

(51) Int. Cl.
*H01F 3/04* (2006.01)
*H01F 7/06* (2006.01)

(52) U.S. Cl. ..... 29/609; 29/592.1; 29/885; 205/90; 205/119; 205/122; 216/12; 216/51; 118/213; 118/301; 118/406; 118/504; 118/721; 427/468; 427/504; 427/510

(58) Field of Classification Search ..... 29/592.1, 29/609, 885; 205/70, 119, 122; 216/12, 216/51; 427/468, 504, 510; 118/213, 301, 118/406, 504, 721
See application file for complete search history.

(56) References Cited

U.S. PATENT DOCUMENTS 4,153,654 A * 5/1979 Maffitt et al. ..... 264/2.5
4,374,869 A * 2/1983 Dorey II et al. ..... 216/17
4,737,447 A * 4/1988 Suzuki et al. ..... 430/321
5,334,908 A * 8/1994 Zimmerman ..... 313/336
5,833,516 A * 11/1998 De Haas et al. ..... 451/29

FOREIGN PATENT DOCUMENTS

JP 09279366 A * 10/1997
JP 09300573 A * 11/1997
JP 19990071583 11/1999
JP 2000012238 1/2000
JP 20000060589 9/2001

OTHER PUBLICATIONS

"Strip waveguides in LiNbO3fabricated by combined metal diffusion and ion implantation"; Heibei, J.; Voges, E.; Quantum Electronics, IEEE Journal of vol. 18, Issue 5; May 1982 pp. 820-825.*

* cited by examiner

*Primary Examiner*—Paul D. Kim
(74) *Attorney, Agent, or Firm*—Stein, McEwen & Bui, LLP

(57) ABSTRACT

A mask frame assembly for evaporation includes a mask and a frame which supports the mask. The mask includes a metal layer having a predetermined pattern, and a coating layer which is formed on a surface of the metal layer so as to increase a precision of the predetermined pattern and a surface roughness of the mask.

27 Claims, 6 Drawing Sheets

METHOD OF MANUFACTURING A MASK FOR EVAPORATION

CROSS-REFERENCE TO RELATED APPLICATIONS

This application claims the benefit of Korean Patent Application No. 2002-30614, filed May 31, 2002, in the Korean Intellectual Property Office, the disclosure of which is incorporated herein by reference.

BACKGROUND OF THE INVENTION

1. Field of the Invention

The present invention relates to a mask for evaporation, a mask frame assembly including the mask for evaporation, and methods of manufacturing the mask and the mask frame assembly, and more particularly, to a stack structure of a material which forms a mask for evaporation, and an improved method of manufacturing the mask using an electro-deposition method.

2. Description of the Related Art

FIG. 1 shows a conventional mask 10 used to evaporate organic films or electrodes during the manufacture of organic electroluminescent display devices. The mask 10 is supported by a frame 20 so as to apply tension to the mask 10. The mask 10 has a structure in which predetermined slots 11 are formed to form a plurality of organic films or electrodes on a thin film. The mask 10 can be manufactured through an etching method or an electro forming method.

According to a conventional etching method, a photoresist layer having a slot pattern is formed on a thin film by a lithography method, or a film having a slot pattern is attached to a thin film. Thereafter, the thin film is etched. However, with an increase of the size of the mask and an increase of fineness of the slot pattern, the conventional etching method does not match or meet width and edge allowances for the slots 11. In particular, when the mask 10 is manufactured by etching a thin film, where the thin film is over-etched or under-etched, the size of the slots 11 is not uniform.

According to a conventional electro forming method, a metal is evaporated on a matrix to a desirable thickness, due to electrolysis of a metal salt by an operation such as an electroplating, and is then lifted from the matrix, thereby forming an electrocasted product having reverse concaves and convexes to the matrix. The mask 10 is manufactured using the above-described principle. In the electro forming method, the mask 10 is formed of an alloy of nickel (Ni) and cobalt (Co). When this alloy is used, high surface roughness and high precision of a slot pattern can be achieved. However, cracks occur in the mask 10 during a welding of the mask 10 to the frame 20 due to the bad welding characteristic of the alloy. In other words, where cobalt is alloyed with another metal, both hardness and stiffness increase, thereby increasing the fragility. Accordingly, as shown in FIG. 2, cracks easily occur during a welding of the mask 10 to the frame 20, where the mask 10 is manufactured using the conventional electro forming method.

Embodiments of a conventional mask frame assembly are disclosed in Japanese Patent Publication Nos. 2000-60589, 1999-71583, and 2000-12238.

SUMMARY OF THE INVENTION

Accordingly, it is an aspect of the present invention to provide a mask for evaporation, a mask frame assembly including the mask for evaporation, and methods of manufacturing the mask and the mask frame assembly, by which the ductility of the mask is increased to suppress the occurrence of cracks, where the mask is welded with a frame.

Additional aspects and advantages of the invention will be set forth in part in the description which follows and, in part, will be obvious from the description, or may be learned by practice of the invention.

To achieve the above and/or other aspects of the present invention, there is provided a mask for evaporation, comprising a metal layer having a predetermined pattern, and a coating layer which is formed on a surface of the metal layer so as to increase a precision of the predetermined pattern and a surface roughness of the mask.

The coating layer may have a lower ductility than the metal layer. The metal layer may comprise nickel and have a thickness of 28–48 μm, and the coating layer may comprise an alloy of nickel and cobalt and have a thickness of 2–17 μm. The alloy may be formed of 85 weight % of the nickel and 15 weight % of the cobalt.

The metal layer may comprise iron, chromium and nickel, and the coating layer may comprise an alloy of iron, chromium, nickel, and cobalt.

The coating layer may be formed on either a bottom surface or a top surface of the metal layer or formed on both bottom and top surfaces of the metal layer. An upper coating layer may have the same thickness as a lower coating layer.

To achieve the above and/or other aspects of the present invention, there is provided a mask frame assembly for evaporation, comprising a mask which includes a metal layer having a predetermined pattern and a coating layer that is formed on a surface of the metal layer so as to increase a precision of the predetermined pattern and a surface roughness of the mask, and a frame which supports the mask.

To achieve the above and/or other aspects of the present invention, there is provided a method of manufacturing a mask for evaporation, which includes a metal layer and a lower coating layer, the method comprising forming the lower coating layer to a predetermined thickness using a plate having the same pattern as the mask so as to increase a precision of the pattern of the mask and a surface roughness of the mask, forming the mask by forming the metal layer to a predetermined thickness on the lower coating layer, and lifting the mask from the plate.

The method may further comprise forming an upper coating layer on the metal layer after the forming of the mask.

To achieve the above and/or other aspects of the present invention, there is provided a method of manufacturing a mask frame assembly for evaporation, the mask frame assembly having a frame and a mask which includes a metal layer and a lower coating layer, the method comprising forming the lower coating layer to a predetermined thickness using a plate having the same pattern as the mask so as to increase a precision of the pattern of the mask and a surface roughness of the mask, forming the mask by forming the metal layer to a predetermined thickness on the lower coating layer, lifting the mask from the plate, and fixing the mask to the frame so as to apply tension to the mask.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
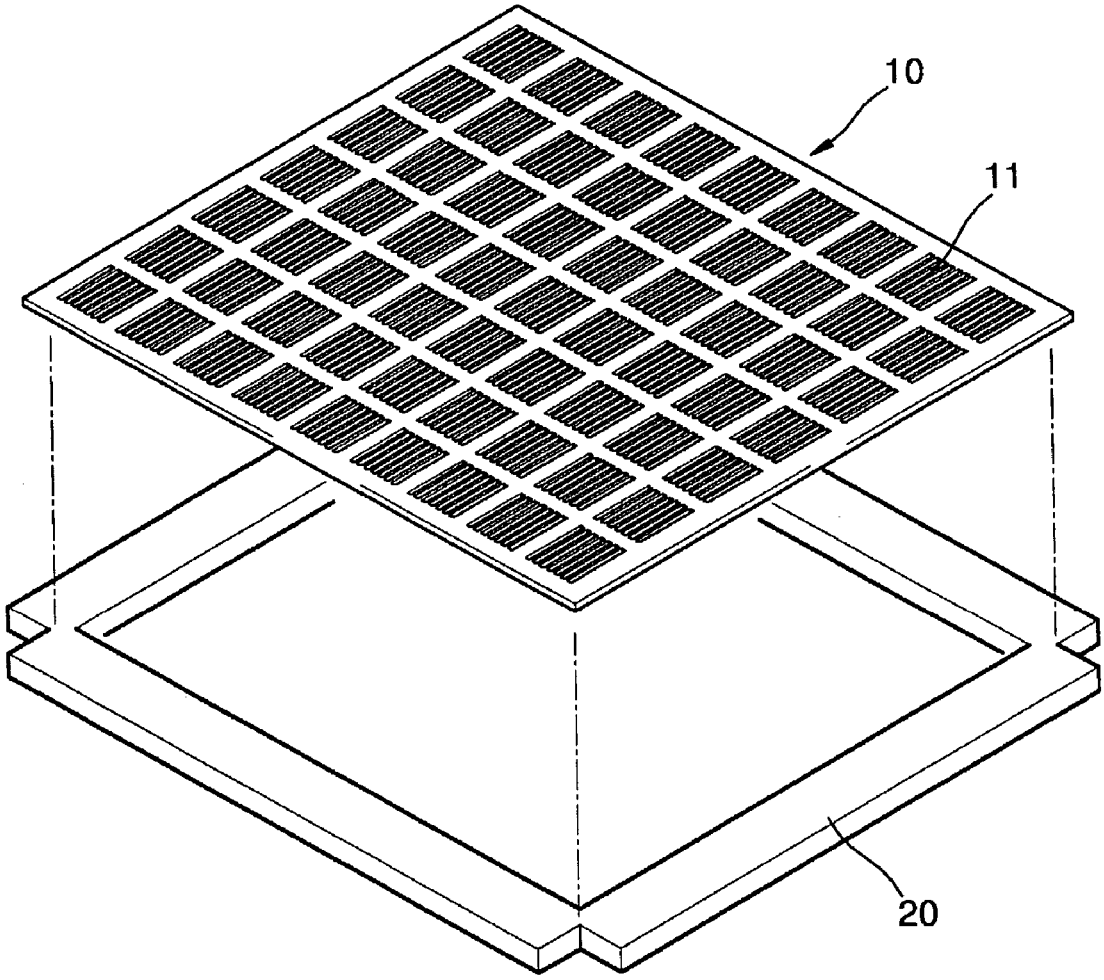
FIG. 1 (PRIOR ART)
FIG. 1 is an exploded perspective view of a conventional mask frame assembly.
Figure 2:
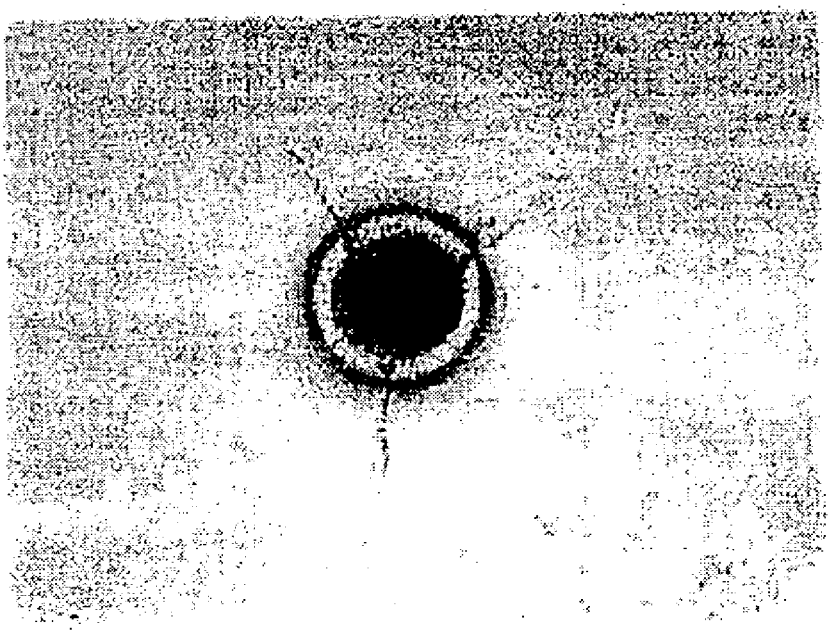
FIG. 2 (PRIOR ART)
FIG. 2 is a front view of a portion of a mask containing cobalt, which is welded to a frame.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
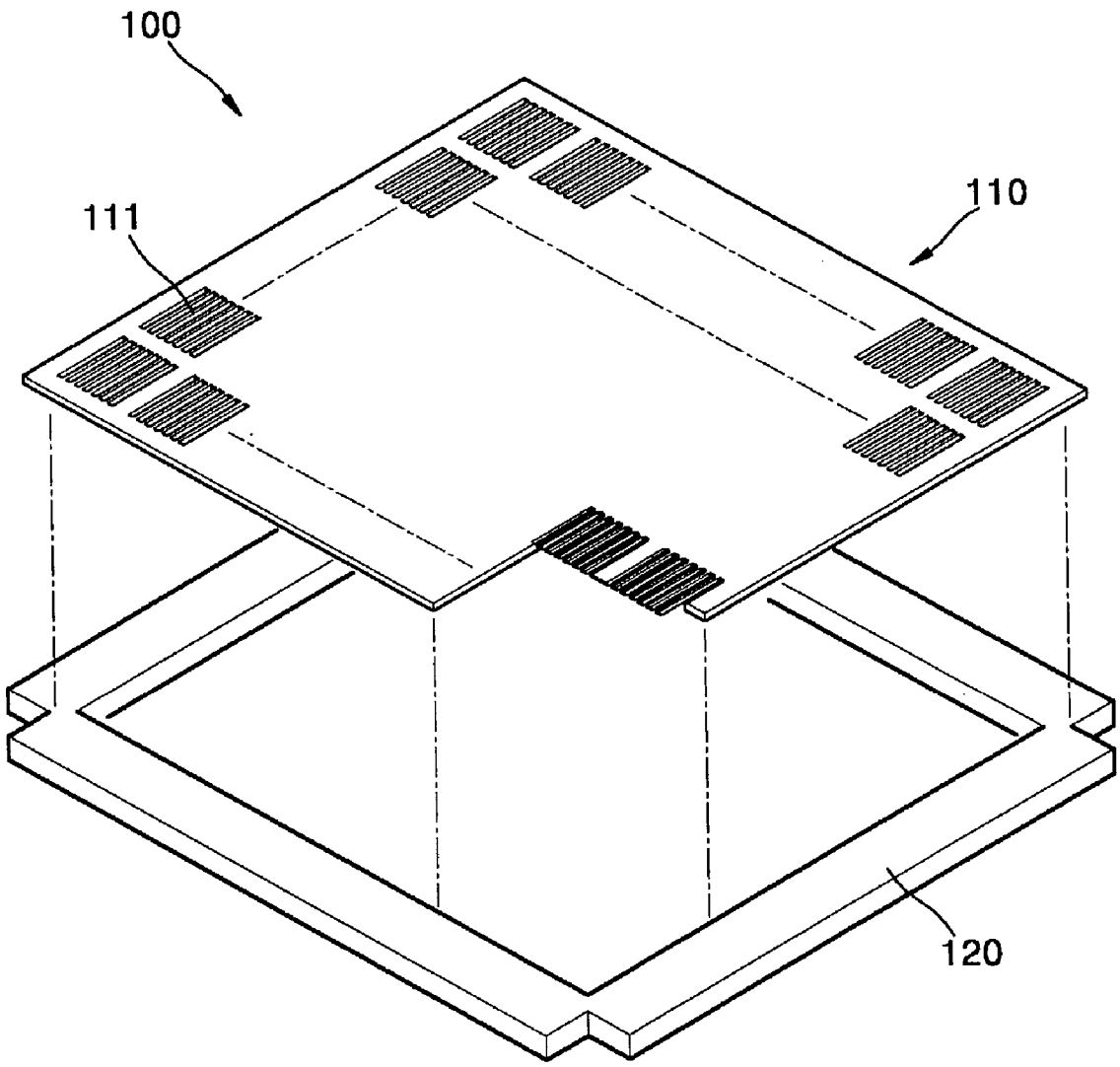
FIG. 3 is an exploded perspective view of a mask frame assembly according to an embodiment of the present invention.
Figure 4:
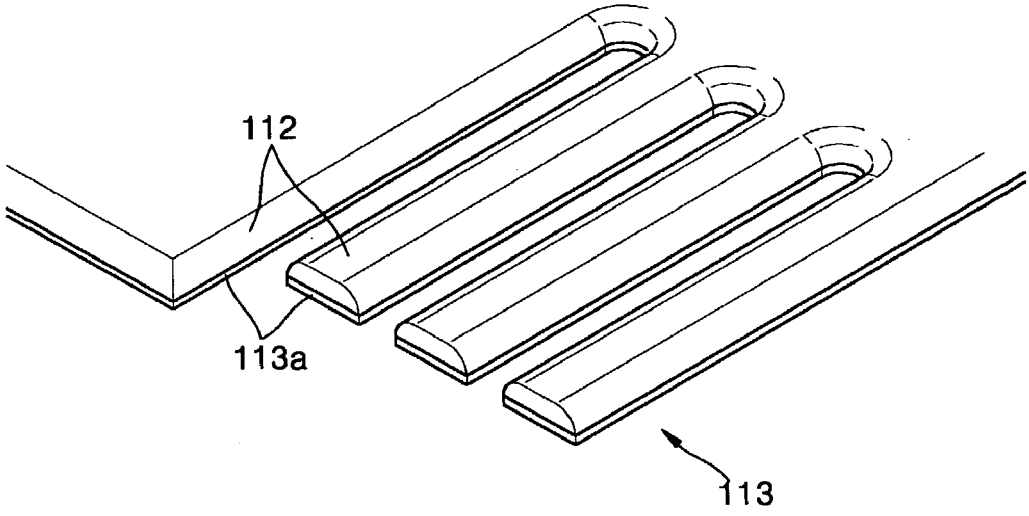
FIGS. 4 and 5 are fragmentary perspective views of a mask according to the present invention.
Figure 5:
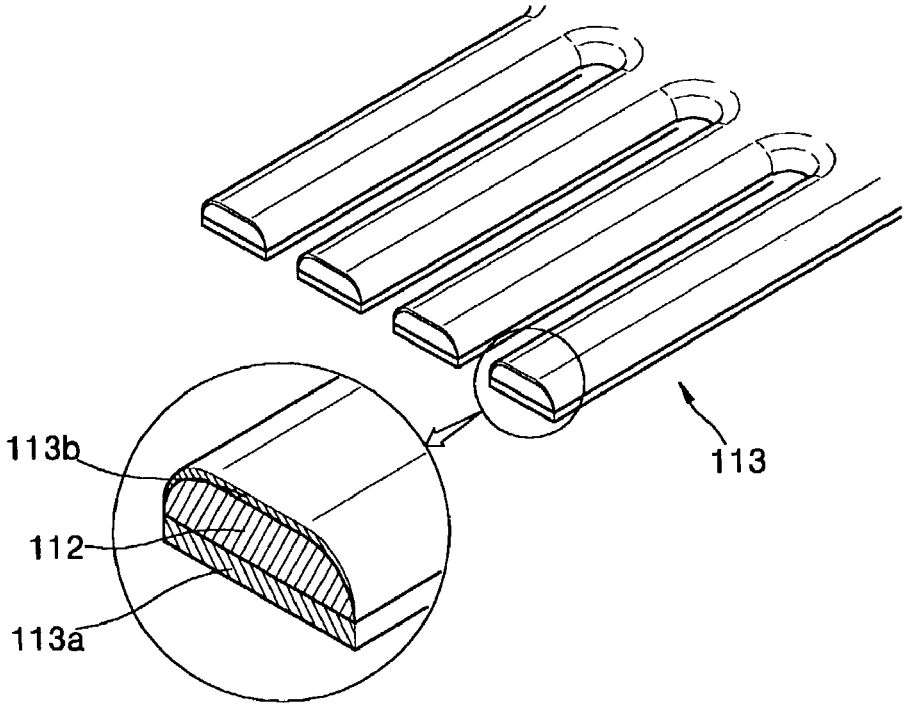

FIGS. 3 through 5 show a mask frame assembly for an evaporation, according to an embodiment of the present invention. Referring to FIGS. 3 through 5, a mask frame assembly 100 includes a mask 110 having slots 111 in a predetermined pattern and a frame 120 which supports the mask 110 so as to apply tension to the mask 110.

The mask 110 includes a thin metal element 112, which is formed of a first metal, for example, nickel (Ni), having a ductility and in which the slots 111 are formed in the predetermined pattern, and a coating layer 113, which is formed by coating the metal element 112 with a second metal to increase a precision of the slots 111 and a surface roughness of the mask 110. The first metal can be 100% pure nickel. However, any metal having a structure in which the metal element 112 having the slots 111 can be manufactured, can be used as the first metal. The coating layer 113 is formed of, for example, an alloy of nickel and cobalt (Co). The alloy may be formed of 85 wt. % of nickel and 15 wt. % of cobalt. The metal element 112 may have a thickness of 28–48 μm, and the coating layer 113 may have a thickness of 2–17 μm. In another aspect, the metal element 112 may be formed of an alloy containing iron (Fe), chromium (Cr), and nickel as major components, and the coating layer 113 may be formed of an alloy of the metal element 112 and cobalt.

FIGS. 6A through 6D, with reference to FIGS. 3 through 5, illustrate a method of manufacturing a mask frame assembly for an evaporation, according to the present invention. A mask of the mask frame assembly is manufactured by, for example, an electro forming method.

Figure 6A:
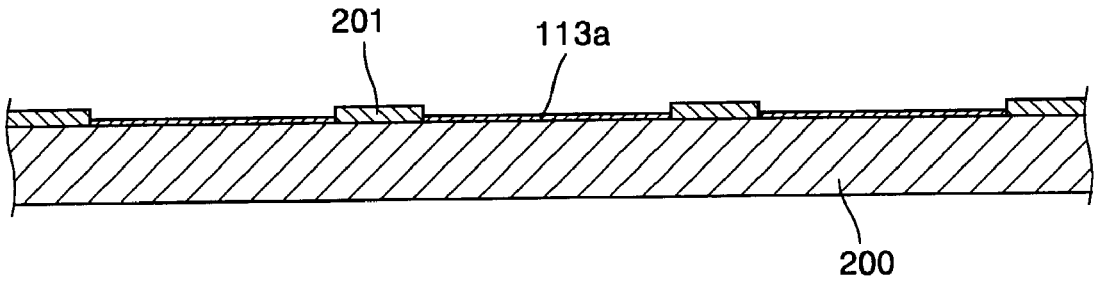
FIGS. 6A through 6D are sectional views illustrating a method of manufacturing a mask according to the present invention.

A plate 200 for an electrodeposition, onto which a film 201 is attached, is prepared. The film 201 penetrates portions corresponding to strips so as to form the appearance of the mask 110 and slots 111. After preparing the plate 200, as shown in FIG. 6A, a lower coating layer 113*a* is formed as a part of a coating layer 113 by electro-depositing the second metal to a thickness of, for example, 5 μm on the plate 200, which is exposed through the film 201, using the electro forming method.

Figure 6B:
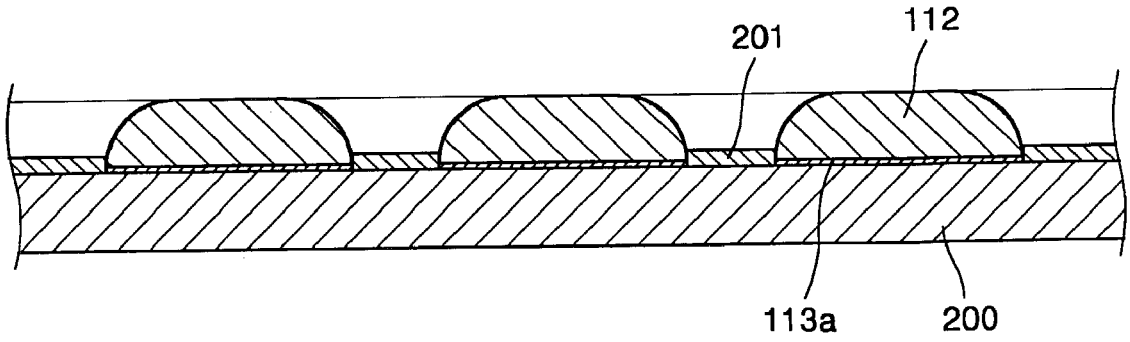

After forming the lower coating layer 113*a*, as shown in FIG. 6B, a metal element 112 of the mask 110 is formed by electro-depositing the first metal nickel, which has a higher ductility than the second metal, on a top surface of the lower coating layer 113*a*. The metal element 112 may be formed to have a thickness of 28–48 μm. The electrodeposition methods for forming the lower coating layer 113*a* and the metal element 112 can be variously changed or adjusted according to the use conditions of the mask 110.

Figure 6C:
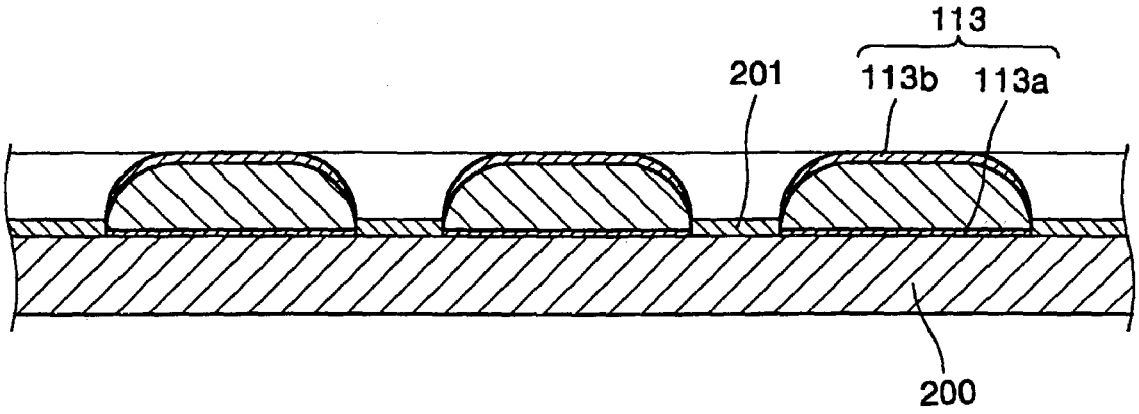

After forming the metal element 112, as shown in FIG. 6C, an upper coating layer 113*b*, formed of the second metal, is formed on a top surface of the metal element 112. The upper coating layer 113*b* may be formed to have the same thickness as the lower coating layer 113*a*.

Figure 6D:
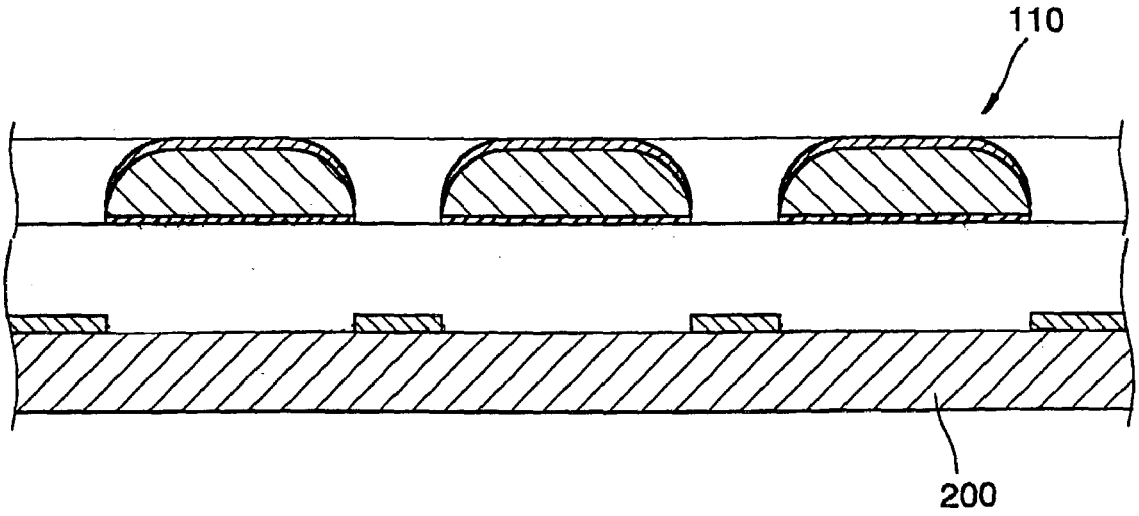

After completing the electrodeposition to manufacture the mask 110, the mask 110 is lifted from the plate 200, as shown in FIG. 6D. Thereafter, the mask 110 is fixed to and supported by the frame 120 so as to apply tension to the mask 110. For example, the mask 110 is fixed to the frame 120 so as to uniformly apply tension throughout the mask 110, thereby preventing the deformation of the slots 111.

As described above, the metal element 112 of the mask 110 is formed of, for example, nickel having a high ductility, thereby preventing portions of the mask 110 welded to the frame 120 from cracking. In addition, since the coating layer 113 is formed on an outer surface of the metal element 112, the yield strength of the mask 110 increases, and the deformation of the slots 111 formed in the mask 110 can be suppressed. Furthermore, the coating layer 113 increases the surface roughness of the mask 110, thereby increasing the precision of the slots 111 and allowing the mask 110 to be smoothly cleaned. Moreover, where the mask 110 is formed by an electro forming method, strips defining the slots 111 have a curved shape, thereby reducing a shadow effect that may occur during an evaporation.

Additionally, the occurrence of cracks is minimized, where the mask 110 is welded to the frame 120. The yield strength is also increased, thereby minimizing the deformation of the mask 110.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of manufacturing a mask for evaporation, the method comprising:

providing a plate having a pattern corresponding to openings to be formed in the mask;

forming a lower coating layer to a predetermined thickness on a portion of the plate not corresponding to the openings to be formed in the mask;

forming a metal layer to a predetermined thickness on the lower coating layer, wherein the lower coating layer has a lower ductility than the metal layer; and lifting the mask comprising the formed layers from the plate.

2. The method of claim 1, wherein the metal layer has a thickness of 28–48 μm, and the lower coating layer has a thickness of 2–17 μm.

3. The method of claim 1, wherein the metal layer is nickel, and the lower coating layer is an alloy of nickel and cobalt.

4. The method of claim 3, wherein the alloy is formed of 85 weight % of the nickel and 15 weight % of the cobalt.

5. The method of claim 4, further comprising forming an upper coating layer on the metal layer.

6. The method of claim 5, wherein the upper coating layer has the same thickness as the lower coating layer.

7. The method of claim 1, wherein the metal layer comprises iron, chromium and nickel, and the lower coating layer is an alloy of iron, chromium, nickel, and cobalt.

8. The method of claim 1, wherein the lower coating layer is formed by an electro forming method.

9. The method of claim 1, wherein the metal layer comprising iron, chromium and nickel, and the lower coating layer is an alloy comprising iron, chromium, nickel, and cobalt.

10. The method of claim 1, wherein the forming of the metal layer includes forming strips in the metal layer to have a curved shape.

11. A method of manufacturing a mask for evaporation, the method comprising:

providing a plate having a film covering portions of the plate corresponding to openings to be formed in the mask;

forming a lower coating layer to a predetermined thickness on portions of the plate not covered by the film;

forming a metal layer to a predetermined thickness on the lower coating layer, wherein the lower coating layer has a lower ductility than the metal layer; and lifting the formed layers from the plate.

12. The method of claim 11, wherein the metal layer has a thickness of 28–48 μm, and the lower coating layer has a thickness of 2–17 μm.

13. The method of claim 11, wherein the metal layer is nickel, and the lower coating layer is an alloy of nickel and cobalt.

14. The method of claim 13, wherein the alloy is formed of 85 weight % of the nickel and 15 weight % of the cobalt.

15. The method of claim 14, further comprising forming an upper coating layer on the metal layer.

16. The method of claim 15, wherein the upper coating layer has a same thickness as the lower coating layer.

17. The method of claim 15, wherein the lower coating layer is formed by an electro forming method.

18. The method of claim 11, wherein the forming of the metal layer includes forming strips in the metal layer to have a curved shape.

19. A method of manufacturing a mask for evaporation, the method comprising:

providing a plate having a pattern corresponding to openings to be formed in the mask;

forming a first layer to a predetermined thickness on a portion of the plate not corresponding to the openings to be formed in the mask;

forming a second layer to a predetermined thickness on the first layer; and lifting the mask comprising the formed layers from the plate, wherein:

the second layer is formed of a first metal, and the first layer is formed of an alloy comprising the first metal and a second metal, the alloy having a ductility less than a ductility of the first metal.

20. The method of claim 19, wherein the first metal is nickel and the second metal is cobalt.

21. The method of claim 20, further comprising:

forming a third layer on the second layer, the third layer formed of a same alloy as the first layer.

22. The method of claim 19, wherein the alloy is formed of 85 weight % of nickel and 15 weight % of cobalt.

23. The method of claim 22, further comprising:

forming a third layer on the second layer, the third layer formed of a same alloy as the first layer.

24. The method of claim 19, further comprising:

forming a third layer on the second layer, the third layer formed of a same alloy as the first layer.

25. The method of claim 24, wherein:

the first metal is another alloy comprising iron, chromium and nickel, and the second metal is cobalt.

26. The method of claim 19, wherein:

the first metal is another alloy comprising iron, chromium and nickel, and the second metal is cobalt.

27. The method of claim 19, wherein the forming of the second layer includes forming strips in the second layer to have a curved shape.

* * * * *

UNITED STATES PATENT AND TRADEMARK OFFICE

CERTIFICATE OF CORRECTION

PATENT NO. : 7,185,419 B2
APPLICATION NO. : 10/448133
DATED : March 6, 2007
INVENTOR(S) : Chang Ho Kang et al.

It is certified that error appears in the above-identified patent and that said Letters Patent is hereby corrected as shown below:

On the Title Page, Item (75) Inventors, change second inventor's city from "Rusan" to --Busan--

Signed and Sealed this

Twenty-second Day of September, 2009

David J. Kappos

David J. Kappos
*Director of the United States Patent and Trademark Office*